US005827128A

United States Patent [19]

Finch et al.

[11] Patent Number: 5,827,128

[45] Date of Patent: Oct. 27, 1998

[54] GOLF STROKE ALIGNMENT TOOL

[75] Inventors: Neil Finch, La Quinta; Bob DuPaix, Roseville, both of Calif.

[73] Assignee: Neil Finch, Inc., La Quinta, Calif.

[21] Appl. No.: 934,403

[22] Filed: Sep. 19, 1997

Related U.S. Application Data

[60] Provisional application No. 60/026,530, Sep. 23, 1996.

[51] Int. Cl.[6] ..... A63B 69/36

[52] U.S. Cl. ..... 473/267; 473/272; 473/273

[58] Field of Search ..... 473/267, 218, 473/272, 273

[56] References Cited

U.S. PATENT DOCUMENTS

| | | | |
|---|---|---|---|
| 4,383,687 | 5/1983 | Wolff | 473/267 |
| 4,563,010 | 1/1986 | McDorman et al. | 473/297 |
| 5,116,058 | 5/1992 | Theriault | 473/267 X |
| 5,190,284 | 3/1993 | Diaz | 473/267 |
| 5,616,085 | 4/1997 | La Coste et al. | 473/267 |

OTHER PUBLICATIONS

Golf Works Magazine, 1995 pp. 15 and 16.

*Primary Examiner*—George J. Marlo
*Attorney, Agent, or Firm*—Haynes and Boone, L.L.P.

[57] ABSTRACT

A golf stroke alignment tool for aligning a golfer with a golf ball is disclosed herein. The alignment tool includes two members. In operation, the first member extends perpendicularly from the golfer's stance, thereby aligning the position of the golf ball with respect to the golfer's stance. The second member extends in parallel with respect to a target line for the ball, thereby indicating an alignment for the golfer's stance with respect to the target line. The second member also includes additional alignment devices, such as measurement markings for directing the exact location for the golfer's feet, and two rotatably adjustable mirrors parallel to the target line to allow the golfer to view his alignment with respect to the target line. In storage, the first and second members can be rotated so that they easily fit inside a golf bag.

21 Claims, 2 Drawing Sheets

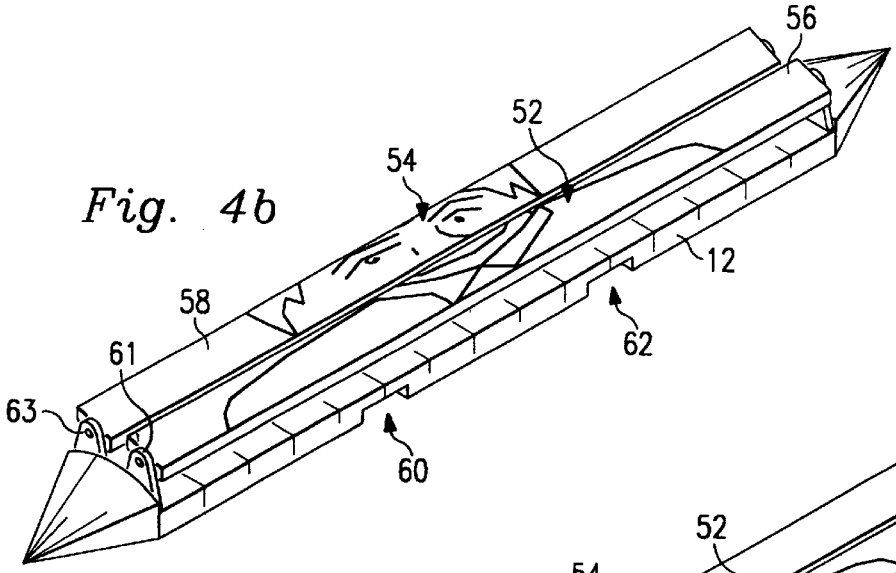
Fig. 4b
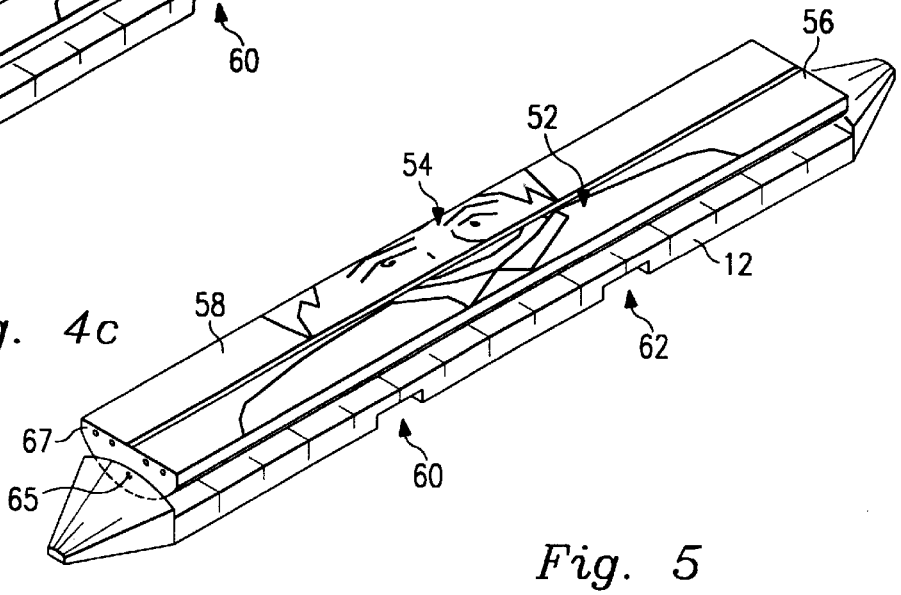
Fig. 4c
Fig. 5
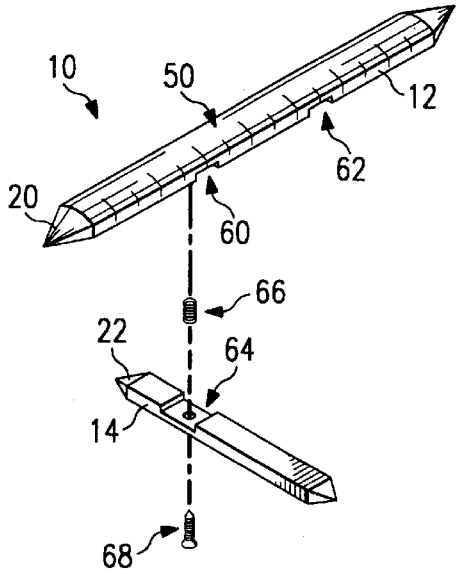
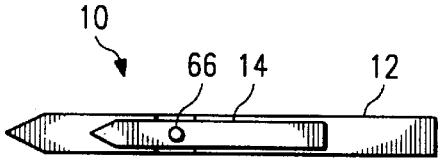
Fig. 6

GOLF STROKE ALIGNMENT TOOL

CROSS REFERENCE

This application claims the benefit of U.S. Provisional Application Ser. No. 60/026,530, filed Sep. 23, 1996.

TECHNICAL FIELD

This invention relates generally to sports equipment and more particularly to an apparatus to assist in aligning a golfer's body to a golf ball and a desired target line for the golf ball.

BACKGROUND OF THE INVENTION

In golf, it is essential for the golfer to properly align his body with the golf ball in relationship to the target. Without such proper alignment, it is difficult, if not impossible, to hit the ball well. Listed below are several problems resulting from improper body alignment:

Improper alignment of the golfer's feet causes an improper swing path, thereby causing a varied and inconsistent ball flight. The feet should be aligned parallel to the target line.

Improper alignment of the shoulders and eyes causes an improper swing path of the golf club, consequently causing a varied and inconsistent ball flight. The shoulders should be squared to or parallel to the target line and the eyes should be focused on the ball in the proper position parallel to the intended flight path.

Improper width of stance creates an inefficient swing. The feet should be a comfortable and effective distance apart. A stance too wide can restrict body movement and turn. A stance too narrow can allow excess body movement and turn, as well as a lack of balance.

Improper ball location within the stance affects the club/ball impact and caused inconsistencies. Only with proper ball placement can the ball be contacted at the bottom point of the swing arc, thus ensuring proper contact. If the ball is placed too far forward in the stance, or towards the target, the path is affected by the club going to the left, commonly known as a pulled shot for a right-handed golfer. If the ball is placed too far to the rear of the stance, the path is affected by the club going to the right, commonly referred to as a pushed shot for a right-handed golfer.

Several teaching aids have attempted to correct body alignment, but each of these aids present other problems. Some teaching aids rely on large, cumbersome devices that can not be easily transported to a golf course or driving range. Other teaching aids physically attach to either the golf club or the golfer's body, thereby producing only limited benefit after the aid is removed. Still other teaching aids require either another person or a video recording device to monitor such things as the golfer's shoulder alignment.

Therefore, what is needed is a teaching aid that is relatively small and convenient to transport.

Furthermore, what is needed is a teaching aid that does not attach to the golf club or the golfer's body.

Further still, what is needed is a teaching aid that can be used individually, yet still give the golfer feedback on such things as his shoulder alignment.

SUMMARY OF THE INVENTION

The foregoing problems are solved and a technical advance is achieved by a golf swing training device for aligning a golfer with a golf ball. The device includes two members that can be place in one arrangement during operation and another arrangement when being stored. In operation, the first member extends perpendicularly from the golfer's stance, thereby aligning the position of the golf ball with respect to the golfer's stance. The second member extends in parallel with respect to a target line for the ball, thereby indicating an alignment for the golfer's stance with respect to the target line. The second member also includes additional alignment devices, such as measurement markings for directing the exact location for the golfer's feet and a reflective surface to allow the golfer to view his body with respect to the target line. Once properly aligned, the golfer may redirect his view from the reflective surface to the ball and then make his swing from that position. Furthermore, when it is time to store the device, the first and second members can be rotated so that they align, thereby allowing them to easily fit inside a golf bag.

In one embodiment, the reflective surface includes two pivotable mirrors, allowing the golfer to simultaneously view his shoulders and his eyes. In another embodiment, the reflective surface includes a convex mirror, also allowing the golfer to simultaneously view his shoulders and his eyes.

An advantage of the present invention is that it provides for a proper alignment of a golfer's feet so that the golfer is properly aligned to a target. Another advantage of the present invention is that the reflective surface shows proper shoulder and eye alignment in addressing the ball, regardless of the golfer's size or stance.

Another advantage of the present invention, with respect to the embodiment with two pivotable mirrors, is that the mirrors can be adjusted to show proper shoulder and eye alignment for addressing the ball, regardless of the golfer's size or stance.

Another advantage of the present invention is that it provides for a proper width of stance by using a scale adjustable for various golf clubs.

Another advantage of the present invention is that it provides for a proper ball placement in the golfer's stance with the exactness of 90 degrees angles.

Another advantage of the present invention is that it can be used with all golf clubs, including a putter.

Another advantage of the present invention is that it folds to a parallel configuration for placement in a golf bag.

Another advantage of the present invention is that a tensioning device can be used to hold the members together for both operation and storage, as well as to allow equal adjustment for a right or left handed golfer.

BRIEF DESCRIPTION OF THE DRAWINGS

FIGS. 4*a*, 4*b* and 4*c* are isometric views of embodiments of the alignment tool of FIG. 1. FIG. 5 illustrates several different tensioning members to be used with the alignment tool of FIG. 1.

FIG. 6 illustrates the alignment tool of FIG. 1 positioned in a compact, parallel configuration.

DESCRIPTION OF THE PREFERRED EMBODIMENT

Figure 1:
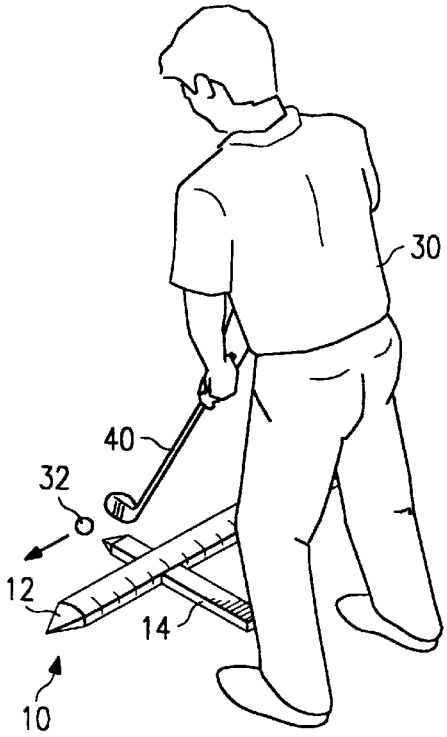
FIG. 1 illustrates a golfer using a golf stroke alignment tool embodying features of the present invention.
Figure 2:
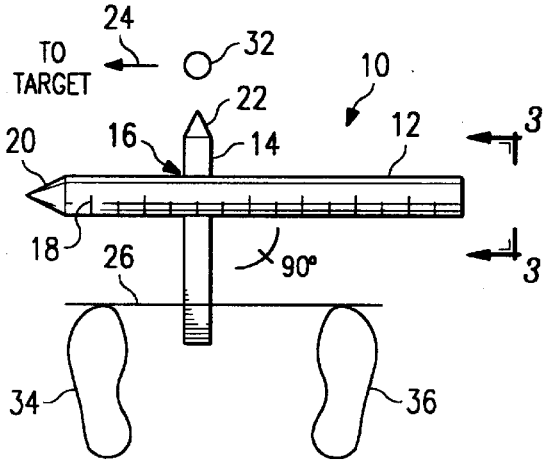
FIG. 2 is a top-down view of the alignment tool of FIG. 1, with outlines of the golfer's feet.

Referring to FIGS. 1 and 2, the reference numeral 10 designates one embodiment of the present invention consisting of three main components: a long shaft 12, a short shaft 14, and a tensioning member 16. The long shaft 12 is thirty three inches long so that, if placed in a golf bag (not shown), it would extend a few inches out of the top of the bag. The long shaft 12 has a series of measurement markings 18 on its top surface, yet in the preferred embodiment, the short shaft 14 has no such markings. Both shafts 12, 14 also include points 20, 22, respectively, on one end and may also have points (see FIG. 5) on the opposite ends to facilitate a left-handed golfer, as described in greater detail, below. The point 20 points to a target (not shown), thereby making the long shaft 12 parallel with a target line 24 and indicating a desired foot alignment 26 parallel with the target line.

In operation, the long shaft 12 and short shaft 14 are arranged so that they cross perpendicularly and are laid flatly on the ground. A golfer 30 (right-handed in the present example) then places a golf ball 32 at a location directly in front of point 22. The golfer 30 may then align his left and right feet 34, 36 in position. Correct foot position is facilitated by the alignment of the long shaft 12 and the measurement markings 18. First of all, with both feet 34, 36 the same distance from the long shaft 12, the feet are in alignment 26, parallel with the target line 24. Next, the feet 34, 36 are positioned with the measurement markings 18. Several different types of measurement markings are anticipated by the present invention. In one embodiment, the measurement markings 18 are coded for different golf club selection. For example, if the golfer 30 is using a driver 40, then specific measurement markings indicate the proper placement for the feet 34, 36, with respect to the golf ball 32, to be used with the driver 40. If, however, a different golf club is used, then different measurement markings will indicate the proper placement for the feet 34, 36, accordingly. As a result, the feet 34, 36 are now in correct alignment with the golf ball 32 and the target line 24.

In another embodiment, the measurement markings 18 may be adjustable or changeable, thereby allowing the golfer 22 to customize his stance for his particular body size and/or stance preference. Also, the adjustable or changeable markings 18 allow the golfer to record his own measurement markings 18, as learned from an instructor, an instructional video, or by trial and error, and will thereby be able to consistently replicate that stance in the future. In yet another embodiment, the markings 18 are inches, centimeters, or some other standardized unit of measurement.

Figure 3:
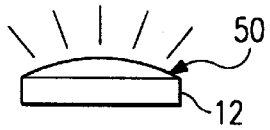
FIG. 3 is a side view of one shaft of the alignment tool of FIG. 1.
Figure 4A:
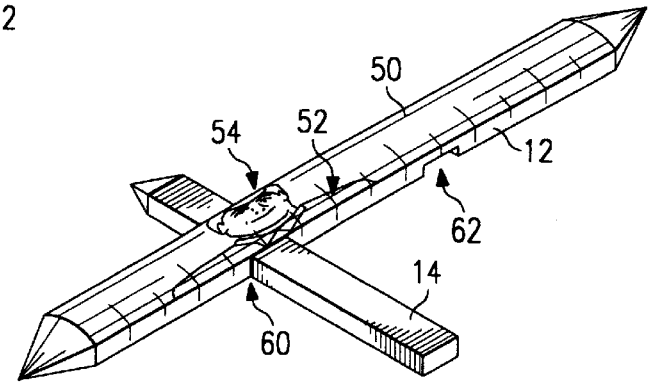

Referring also to FIGS. 3 and 4*a,* a reflective surface 50 is attached to a top surface of the long shaft 12. The reflective surface 50 allows the golfer 30 to view his shoulders 52 and/or eyes 54 to ensure that they are properly aligned with the desired swing path 24. In one embodiment, the reflective surface 50 is convex, thereby facilitating golfers of different sizes and who stand varied distances from the ball to view both their eyes and their shoulders concurrently.

Referring to FIG. 4*b,* in another embodiment, two split mirrors 56, 58 are attached to the top surface of the long shaft 12 through pivots 61, 63, respectively. The split mirrors 56, 58 are relatively flat and can be adjusted towards the golfer 30 to reflect his shoulders 52 and/or eyes 54. The pivots 61, 63 operate independently so that the golfer 30 may simultaneously view both his shoulders 52 in the mirror 56 and his eyes 54 in the mirror 58.

Referring to FIG. 4*c,* in yet another embodiment, the two split mirrors 56, 58 are attached to the top surface of the long shaft 12 at a single pivot 65 through a retaining means 67. The retaining means 67 secures the split mirrors 56, 58 at an angle of approximately 2° so that when the mirror 58 is adjusted to reflect the golfer's eyes 54, the mirror 56 will reflect his shoulders 52. It is anticipated that other mirror arrangements can be used to achieve similar results.

Once the golfer has looked to see that his shoulders 52 and/or eyes 54 are aligned, he can move his eyes towards the ball 32 without moving the rest of his body, including his head. Also, the golfer 30 can make sure that his head is positioned behind the ball 32 by referencing his eye position with respect to the shaft 14. Now that his feet 34 36, shoulders 52, eyes 54, and head are properly aligned, the golfer may then swing the golf club 40 along the target line 24.

Referring also to FIGS. 4*a,* 5 and 6, the long and short shafts 12, 14 are designed so that they quickly rotate back and forth between a perpendicular position (FIG. 2) and a parallel position (FIG. 6). The shafts 12, 14 are capable of 360 degree rotation so that a left-handed golfer can also use the device 10. As discussed above, the perpendicular position is used for normal operation of the device 10. The parallel position, however, makes the device 10 easy to store away, such as in one's golf bag. The flexibility between the two positions is supported by the tensioning member 16.

Referring specifically to FIG. 4*a,* in one embodiment, the tensioning member 16 is a notch 60 in the shaft 12. The shaft 14 fits inside the notch 60 so that the bottom of the shafts 12, 14 are relatively coplanar. The notch 60 is tight enough to frictionally secure the two shafts 12, 14 together at a 90° angle, but loose enough to allow the shaft 14 to move longitudinally inside the notch. With this embodiment, the distance of the point 22 of the shaft 14 from the shaft 12 can be easily adjusted. Also, the shaft 12 may include a second notch 62 to allow the shafts 12, 14 to be interchangeably used by left and right-handed golfers. One benefit of using two notches 60, 62 on the shaft 12 is that only a single group of measurement markings 18 are required for both left and right-handed golfers.

Referring specifically to FIG. 5, in another embodiment, the shaft 14 also includes a notch 64 for engaging with the notch 60 (or the notch 62). The two notches 60, 64 align so that when the shafts 12, 14 are perpendicular, they fit tightly together, thereby preventing any rotational movement. In yet another embodiment, a spring 66 and bolt 68 are attached inside the notches 60, 64 and the spring 66 pulls the notches together, thereby ensuring that the shafts are at right angles to each other. However, if the golfer 30 wants to store the device 10 in his golf bag, then he simply pulls the two shafts 12, 14 apart from each other, thereby disengaging the notches 60, 64, and then rotates the shafts until the device 10 is configured as shown in FIG. 6.

Referring again to FIG. 6, when the shafts 12, 14 are parallely aligned as shown, or when the shaft 14 is removed from the shaft 12, the device 10 may also be used for putting. When putting, the same alignment benefits exist as for other golf swings. In addition, the measurement markings 18 can be used to indicate a proper backswing distance for the club 40. Furthermore, the club 40 can be swung along the body of the shaft 12, thereby reinforcing a swing path parallel with the target line 24.

Although illustrative embodiments of the invention have been shown and described, other modifications, changes, and substitutions are intended in the foregoing disclosure. For example, the device 10 can help to cure a shank by being placed under the golfer's toes to keep his weight off his toes. Accordingly, it is appropriate that the appended claims be construed broadly and in a manner consistent with the scope of the invention.

What is claimed is:

1. A golf-swing improvement device comprising:

a first member;

a second member parallely alignable with a target line that a desired golf ball path should follow;

a tensioning member for selectively engaging and securing the first and second members to each other and at a right-angle configuration with each other; and two mirrors pivotally connected to the second member so that the two mirrors can rotate each on an axis parallel with the other and parallel with the target line, thereby allowing a golfer to simultaneously view two different body portions.

2. The apparatus of claim 1 wherein the tensioning member is an indentation in the second member and wherein when the first members is positioned inside the indentation, the first and second members are secured in the right-angle configuration with each other.

3. The apparatus of claim 1 wherein, when the second member is parallely aligned with the target line, the rotating axis of the two mirrors remain parallel with the target line throughout each mirror's range of rotation.

4. The apparatus of claim 1 wherein the two mirrors are attached to a single pivot and adjusted at an angle with each other so that one mirror allows a golfer to view his shoulders while the other mirror allows the golfer to view his eyes.

5. The apparatus of claim 1 wherein the second member includes alignment marks for aligning the golfer's feet, the alignment marks supporting different widths of stance.

6. The apparatus of claim 1 wherein the first member indicates a location of a golf ball and the two mirrors are in close proximity with each other, but spatially distant from the location of the golf ball.

7. The apparatus of claim 1 wherein both of the mirrors extend along a substantial portion of the second member so that the golfer can view the two different body portions for different alignments of a golfer's feet and ball position with respect to the first member.

8. An apparatus for aligning a golfer with a golf ball, the apparatus comprising:

a first member for aligning a position of the golf ball with respect to the golfer's stance;

a second member for engaging with the first member and having a length for indicating a stance line parallel with a target line so that the golfer's stance may align with the second member and thereby align in parallel with the target line; and two spaced-apart mirrors rotatably attached to the second member, wherein a reflective surface of each mirror remains parallel with the target line thereby allowing the golfer to view two different portions of the golfer's body and determine if the portions are also parallel with the target line.

9. The apparatus of claim 8 wherein the two reflected portions of the golfer's body are selected from a group consisting of: the golfer's eyes, the golfer's head and the golfer's shoulders.

10. The apparatus of claim 9 wherein both of the mirrors extend along a substantial portion of the length of the second member so that regardless of the location of the golfer's stance, the two mirrors always allow the golfer to view the two different portions of the golfer's body.

11. The apparatus of claim 8 wherein the reflected portion of the golfer's body is the golfer's head so that by viewing into the reflective surface, the golfer may align his head behind the golf ball.

12. The apparatus of claim 8 further comprising a notch in the second member for engaging the first and second members in a perpendicular configuration.

13. The apparatus of claim 12 wherein, when the first and second members are in the perpendicular configuration, the golfer may align a face of a golf club perpendicular to the second member.

14. The apparatus of claim 8 wherein the second member includes two notches so that when the first member is engaged with the first notch, the members are in a perpendicular position aligned for a right-handed golfer and when the first member is engaged with the second notch, the members are in a perpendicular position aligned for a left-handed golfer, and wherein when the first and second members are engaged, they are prevented from moving relative to each other.

15. The apparatus of claim 8 wherein the second member can be placed under the golfer's feet while still allowing the first member to align the position of the golf ball.

16. The apparatus of claim 8 wherein each of the two spaced-apart mirrors are individually pivotably adjustable, thereby facilitating golfers of different heights.

17. The apparatus of claim 16 wherein the two spaced-apart mirrors are fixed at a 2° angle from each other.

18. The apparatus of claim 8 further comprising a spring attached to both the first and second members for securing the members together.

19. The apparatus of claim 8 wherein the alignment marks align the golfer's width of stance with respect to the golf ball.

20. The apparatus of claim 8 wherein the second member includes alignment marks to indicate a backswing distance for putting the golf ball.

21. The apparatus of claim 20 wherein the second member provides a physical guide for a putter when putting the golf ball.

* * * * *